US006036116A

United States Patent [19]

Bui

[11] Patent Number: 6,036,116

[45] Date of Patent: Mar. 14, 2000

[54] FLUID ATOMIZING FAN SPRAY NOZZLE

[75] Inventor: Quy Duc Bui, Monroe, N.C.

[73] Assignee: Coltec Industries Inc, Charlotte, N.C.

[21] Appl. No.: 09/165,432

[22] Filed: Oct. 2, 1998

Related U.S. Application Data

[60] Provisional application No. 60/082,000, Apr. 16, 1998.

[51] Int. Cl.[7] ..... B05B 7/04

[52] U.S. Cl. ..... 239/432; 239/433; 239/597

[58] Field of Search ..... 239/418, 419, 239/426, 427, 432–434, 596, 597, 568

[56] References Cited

U.S. PATENT DOCUMENTS

| | | | |
|---|---|---|---|
| 1,691,048 | 11/1928 | Kermor et al. . | |
| 2,764,455 | 9/1956 | Seibel . | |
| 3,587,974 | 6/1971 | Rosenkranz | 239/423 |
| 4,330,086 | 5/1982 | Nysted | 239/432 X |
| 4,349,156 | 9/1982 | Haruch et al. | 239/432 |
| 4,511,087 | 4/1985 | Matsumoto | 239/433 |
| 4,591,099 | 5/1986 | Emory et al. | 239/419 |
| 4,815,665 | 3/1989 | Haruch | 239/432 |
| 4,846,405 | 7/1989 | Zimmermann | 239/422 |
| 4,989,675 | 2/1991 | Papavergos | 169/14 |
| 4,989,788 | 2/1991 | Bendig et al. | 239/429 |
| 5,011,083 | 4/1991 | Matsumoto et al. | 239/590.5 |
| 5,014,790 | 5/1991 | Papavergos | 169/44 |
| 5,242,115 | 9/1993 | Brown | 239/414 |
| 5,427,317 | 6/1995 | Huttlin | 239/422 |
| 5,520,337 | 5/1996 | Fuchs | 239/427 |
| 5,794,857 | 8/1998 | Chen et al. | 239/430 |

*Primary Examiner*—Lesley D. Morris
*Attorney, Agent, or Firm*—Cummings & Lockwood

[57] ABSTRACT

A spray nozzle assembly is disclosed which includes a nozzle body having opposed inlet and outlet ends and an elongated passage extending therebetween. A fluid inlet passage communicates with the elongated passage through a side wall of the nozzle body. A member is disposed within the elongated passage and has a neck portion, a head portion, and an air passage extending therethrough. An annular chamber is defined by the elongated passage and the neck portion. The head portion cooperates with a shoulder defined within the elongated passage and has an outflow slot intersecting the air passage. Fluid is fed through the fluid inlet passage into the annular chamber, is metered into the outflow slot, and therein mixed with air emanating from the air passage.

38 Claims, 4 Drawing Sheets

FLUID ATOMIZING FAN SPRAY NOZZLE

CROSS-REFERENCE TO RELATED APPLICATIONS

This application claims priority to provisional application Ser. No. 60/082,000, filed Apr. 16, 1998, which is herein incorporated by reference.

BACKGROUND OF THE INVENTION

1. Field of the Invention

This invention relates to spray nozzles in general and, more specifically, to an improved spray nozzle assembly which produces an even fan-shaped spray pattern.

2. Background of the Related Art

The desire to accurately control the particle size of fluid sprayed from a spray nozzle has been a challenge for nozzle manufactures for many years. The accurate control of particle size often improves the quality of the overall process employing the nozzle. For example, in the manufacture of continuously cast steel slabs, ingots, billets, or the like, spray nozzles are used to cool a casting as it passes from a mold. The more accurately coolant spray is applied to the surface of the steel, the less likely there will be uneven cooling of the casting. Uneven cooling can create internal stresses in the cast material which could result in stress fractures and, consequently, lost product.

Optimal cooling of a casting can be obtained if spray nozzles apply an even blanket of atomized cooling fluid to the surface of the casting such that the atomized particles readily and completely evaporate upon contact. The spray nozzles must be sufficiently adjustable so that the variables encountered in the casting process are accommodated. For example, the surface speed, attitude, and temperature of the casting are factors that must be considered in applying cooling fluid.

Purely hydraulic spray nozzle systems, wherein fluid is forced by high pressure through small orifices in a nozzle head, were initially used in the prior art to cool casting products. However, such systems did not sufficiently atomize the fluid. This led to excessive amounts of fluid on the surface of the casting surface which in turn caused imperfections in the casting and unusable product. Air-assisted nozzles were later developed and have substantially replaced hydraulic spray systems. Air assisted nozzles permit the distribution of relatively fine fluid spray, thereby consuming significantly less fluid and providing greater cooling per unit volume of cooling fluid than the earlier hydraulic nozzle systems.

An example of a basic air assisted spray nozzle is disclosed in German Patent No. 2,816,441. This apparatus includes an air pipe having a closed top end and a nozzle tip at its bottom end which defines an air mist spraying orifice. An air supply tube penetrates the outer wall of the air pipe adjacent the closed top end. A fluid pipe penetrates the closed top end of the air pipe and extends coaxially for a distance into the air pipe. Fluid is fed into the fluid pipe through the upper end thereof. Air is simultaneously fed into the tubular volume between the inner wall of the air pipe and the outer wall of the fluid pipe. The air and fluid mix in the lower portion of the air pipe. A disadvantage of this prior art nozzle is that the air and fluid do not efficiently mix together since each exits from a respective pipe in essentially parallel co-axial streams. Therefore, relatively long fluid and air pipes are required to effectively mix and atomize the fluid. Consequentially, the device is difficult to adapt to particular applications and ultimately results in a cumbersome and relatively expensive cooling system.

An improvement over this early German device is described in U.S. Pat. No. 4,349,156. This apparatus includes an elongated expansion chamber containing an impingement plate positioned parallel to the longitudinal axis of the chamber. Fluid flow is introduced at high velocity into the chamber at an angle perpendicular to the plate. The fluid strikes the impingement plate and breaks up into finely atomized particles. A high velocity air stream is directed into the chamber along the longitudinal axis thereof and strikes the fluid particles causing them to become further atomized. The atomized particles of fluid are carried along the length of the chamber by the high velocity air stream and exit the chamber through an orifice formed at its end. This apparatus has also been found to be ineffective because of the large amount of air that must be used to achieve a droplet size needed for the efficient and effective cooling required in continuous casting.

A further improvement in the development of spray nozzles is found in U.S. Pat. No. 4,511,087 ("the '087 patent"). This spray nozzle includes a nozzle tip at one end and a casing connected to the opposed end. A liquid supply connector is mounted in a side wall of the casing with a supply port extending therethrough. A nozzle member extends into the casing and includes a gas passage running its full length into a reduced diameter portion of the casing. A receiving chamber is formed between a recessed portion of the nozzle member and an enlarged diameter portion of the casing. The casing further includes an annular constricted middle portion defining a liquid outflow passage around the circumference of the nozzle. The liquid outflow passage provides fluid communication between the receiving chamber and the reduced diameter portion of the casing. Air and fluid are mixed in the reduced diameter portion of the casing.

The apparatus disclosed in the '087 patent has several shortcomings. First, it is difficult to manufacture such spray nozzles so that each has the same output flow characteristic. This is because of the difficulty in manufacturing the spray nozzle with tolerancing so that each includes a liquid outflow passage having the same cross-sectional area. Second, is the less than optimal location in which the mixing of air and liquid occurs, i.e., in the reduced diameter portion of the casing. It has been determined that more efficient and more thorough mixing of air and fluid can be effected if it is caused to occur at a location above the radially restricted portion of the casing.

A third disadvantage is the decay in performance of the spray nozzle over time. This is primarily caused by the buildup of minerals, such as dissolved calcium, which block the relatively small outflow passage. This problem is exacerbated when, as in the disclosed embodiment, the nozzle member includes a forward end that is in contact with the constricted middle portion of the casing and has a number of passage parts in a peripheral wall of the forward end of the nozzle member.

There is clearly a need in the art for a spray nozzle with improved spraying efficiencies. There is also a need in the art for a spray nozzle which can be manufactured so that each spray nozzle produced has consistent spraying characteristics. In addition, there is a need for a spray nozzle that reduces or eliminates the deleterious effects that dissolved minerals will have on the performance of the nozzle over its operational life.

SUMMARY OF THE INVENTION

The subject invention is directed to a highly efficient spray nozzle which includes a nozzle body having opposed inlet and outlet ends and an elongated passage extending therebetween. A fluid inlet passage extends through a wall of the nozzle body to communicate with the elongated passage. A member is disposed within the elongated passage and has a neck portion, a head portion, and an air passage extending therethrough. The head portion is dimensioned and configured to cooperate with a complementary surface within the elongated passage. The complementary surface of the elongated passageway is defined by a shoulder having a surface contacting the head portion of the member. The shoulder surface forms about between a 20° to 60° angle with the longitudinal axis of the elongated passageway of the nozzle body.

The head portion also has an outflow slot intersecting the air passage. The slot extends to the neck portion of the member. In operation, fluid is fed through the fluid inlet passage, between the elongated passage and the neck portion, is metered to the outflow slot, and therein mixed with air emanating from the air passage.

The spray nozzle further includes a nozzle tip having an inlet end and an outlet end with a chamber extending therebetween. An extension tube attaches and provides fluid communication between the outlet end of the nozzle body and the inlet end of the nozzle tip. A slotted pre-orifice member is positioned within the nozzle tip proximate the inlet end for regulating the flow of fluid to the chamber. The nozzle tip further includes a deflection pin which is attached to the nozzle tip proximate the outlet end and extending at an angle perpendicular to the longitudinal axis of the nozzle tip chamber. The outlet end of the nozzle tip includes a discharge orifice formed therein whose longitudinal axis of symmetry lies parallel with the axis of the deflection pin.

Further features of the spray nozzle assembly of the subject invention will become more readily apparent from the following detailed description taken in conjunction with the drawings.

BRIEF DESCRIPTION OF THE DRAWINGS

So that those of ordinary skill in the art to which the subject invention appertains will more readily understand how to make and use the spray nozzle assembly described herein, preferred embodiments of the invention will be described in detail herein below with reference to the drawings wherein.

DETAILED DESCRIPTION OF THE PREFERRED EMBODIMENTS

Figure 1:
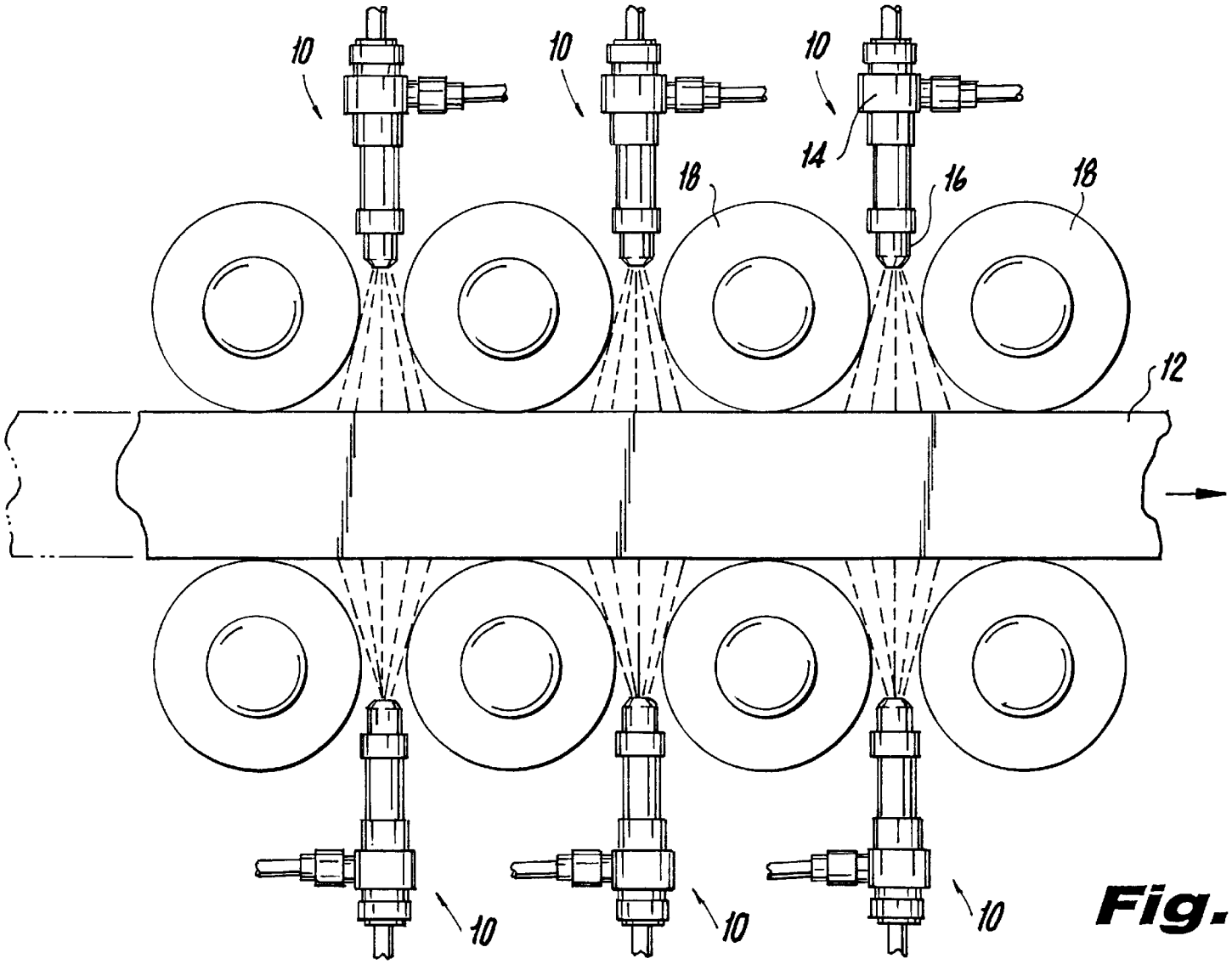
FIG. 1 is an elevational view of a section of a continuous casting apparatus having a series of rollers supporting a casting passing therethrough and further illustrating an arrangement of spray nozzles for cooling the casting.

Referring now to the drawings wherein like reference numerals identify similar structural elements of the subject invention, there is illustrated in FIG. 1 a section of a casting line having a plurality of spray nozzles 10 deployed to cool the surface of a continuous casting 12. To cool the casting 12, pressurized water and air are fed to each spray nozzle 10, mixed within the nozzle body assembly 14 of each spray nozzle, and dispersed from the nozzle tip assembly 16 of each spray nozzle. Preferably, in such a casting line, the spray nozzles 10 are positioned between pairs of support rollers 18 and provide a generally fan shaped spray pattern across the surface of the casting 12 as the casting is fed between the rollers 18. To facilitate the processing of wide castings, one or more spray nozzles 10 may be disposed between each pair of rollers 18, each pair of spray nozzles being positioned so that the spray patterns thereof overlap somewhat, thus ensuring even and complete cooling of the casting 12 as it passes through the roller train.

Those skilled in the art will readily appreciate that spray nozzles 10 may be supported between the rollers in any suitable manner. The support method may include provision for adjusting the relative position of the nozzles with respect to the rollers and appropriate piping for supplying the necessary pressurized air and water to cool the casting 12. The position of each spray nozzle and the respective supply pressure of the air and water depend on several factors, such as, the throughput velocity of the casting, the temperature of the casting, the particular alloy of the casting, and the temperature and pressure of the air and water supply.

Figure 2:
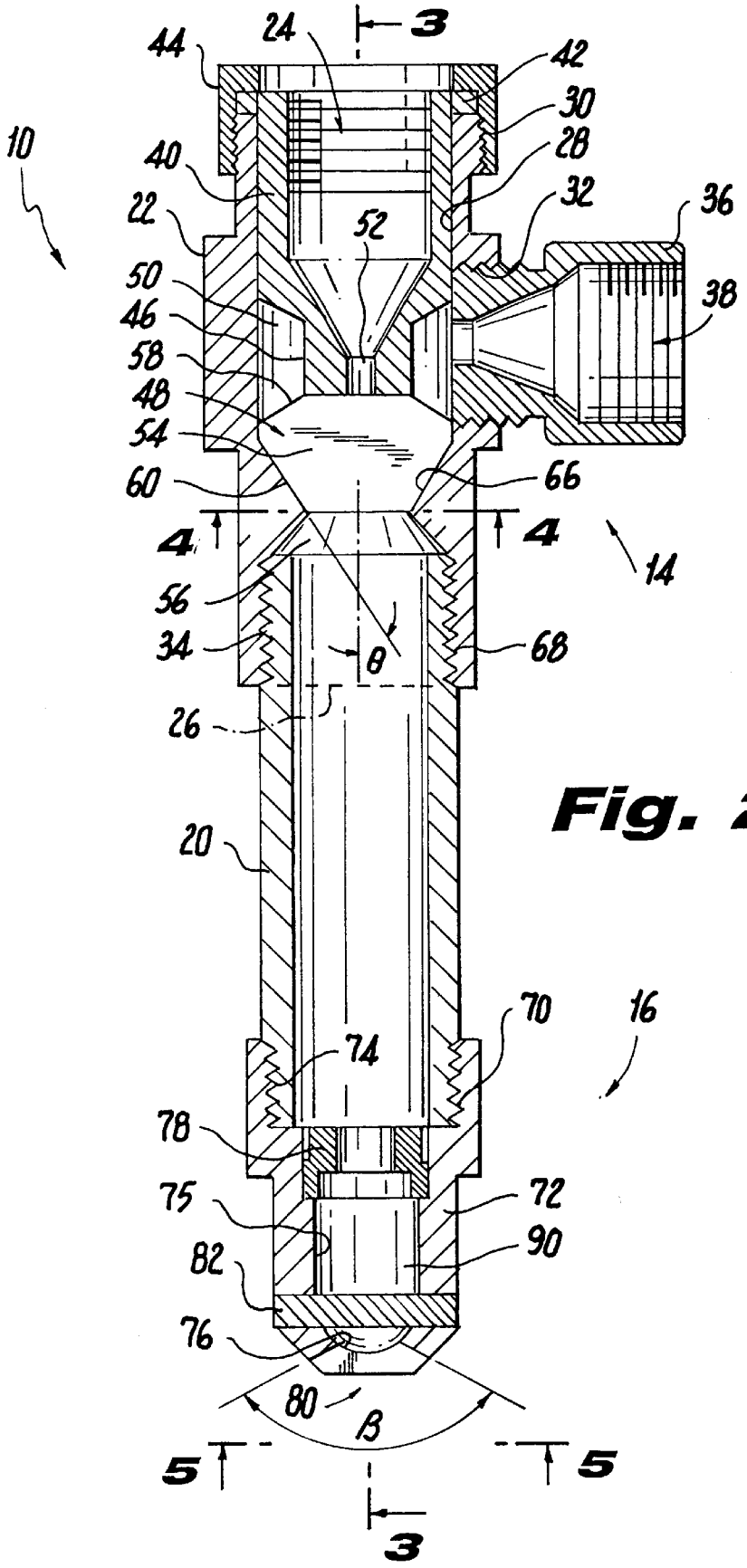
FIG. 2 is a side elevational view in cross-section of a spray nozzle constructed according to an embodiment of the present invention.

Referring now to FIG. 2, there is illustrated a preferred embodiment of the spray nozzle 10. As noted above, spray nozzle 10 includes nozzle body assembly 14, nozzle tip assembly 16, and an extension tube 20 which provides fluid communication between nozzle body assembly 14 and nozzle tip assembly 16.

The nozzle body assembly 14 includes a nozzle body 22 having a generally cylindrical geometry with an inlet end 24 and an opposed outlet end 26. An elongated passage 28 extends between the inlet end 24 and outlet end 26, and an externally threaded hub 30 is formed at the inlet end 24. An internally threaded hub 32 is formed in the side wall of nozzle body 22 to provide a passage which intersects elongated passage 28 at an angle, which is preferably approximately 90°. An internally threaded hub 34 is also formed at the outlet end 26 of nozzle body 22.

The nozzle assembly 14 further includes a fluid inlet fitting 36 having external threading for mating with threaded hub 32 of nozzle body 22. Fluid inlet fitting 36 includes a fluid inlet passage 38 and an internally threaded portion for facilitating a connection with a pressurized fluid supply (not shown). Fluid inlet passage 38 is tapered to a predetermined diameter for controlling the flow of fluid that passes therethrough.

An air inlet member 40 which includes a flange 42 extends into elongated passage 28 through the inlet end 24 of nozzle body 22. A cap nut 44 having internal threads and a through-hole is fully engaged with threaded hub 30, thereby clamping flange 42 to nozzle body 22. Air inlet member 40 includes a neck portion 46 and a head portion 48. Neck portion 46 is adjacent fluid inlet passage 38 and forms an annular fluid chamber 50 into which fluid is fed through fluid inlet fitting 36 from a fluid supply. An air orifice 52 extends through air inlet member 40 and is tapered to a predetermined diameter for controlling the flow of air therethrough.

Figure 3:
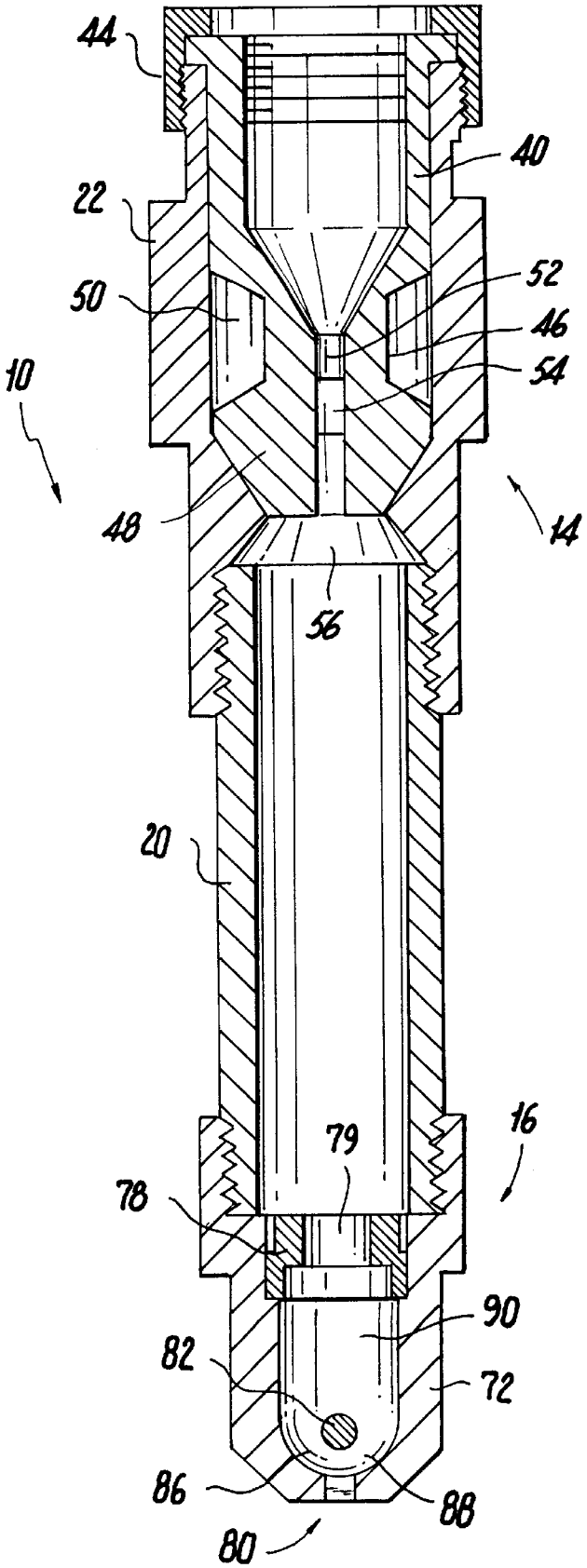
FIG. 3 is a side elevational view in cross-section, taken along line 3—3 of FIG. 2, of the spray nozzle assembly of the present invention to better illustrate the geometry of an outflow slot in the air inlet member thereof and the position of a deflection pin in the nozzle tip thereof.
Figure 4:
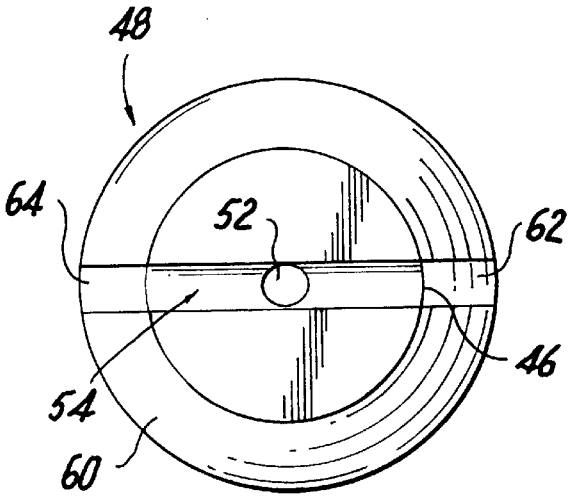
FIG. 4 is an end view, taken along line 4—4 of FIG. 2, with the nozzle body and fluid inlet fitting of the assembly removed for better illustrating the lateral fluid orifices of the air inlet member.

Referring now to FIGS. 2 and 3, an outflow slot 54 is formed in head portion 48, through which fluid is injected from annular fluid chamber 50 into a mixing chamber 56. Slot 54 may have a variety of shapes without departing from the preferred embodiment of the invention. For example, slot 54 may be V- or U-shaped. Such alternative shapes may provide fluid flows more acceptable in particular applications. Head portion 48 also includes an upper tapered surface 58 and a lower tapered surface 60. Referring now to FIG. 4 in conjunction with FIGS. 2 and 3, upper tapered surface 58 is dimensioned and configured to provide sufficient relief so as to intersect slot 54, thereby forming two lateral fluid orifices 62 and 64. Slot 54 is oriented perpendicular to liquid inlet passage 38 so that liquid is equally injected through lateral fluid orifices 62 and 64. In addition, upper tapered surface 58 directs the flow of fluid immediately inward toward the upper region of mixing chamber 56.

Referring again to FIG. 2, depending upon the geometry of air inlet member 40, lower tapered surface 60 may or may not contact an annular shoulder 66 of elongated passage 28. It is preferable that if the lower tapered surface 60 and the annular shoulder 66 are not in contacting relationship, then the gap formed therebetween is at a minimum dimension such that a substantial portion of fluid flowing from annular fluid chamber 50 passes through lateral fluid orifices 62 and 64. In a preferred embodiment, lower tapered surface 60 is at an angle θ with respect to the longitudinal axis of air inlet member 40. In a preferred embodiment, angle θ is about 20° to 60°.

It should be noted, however, that the air inlet member 40 may be formed without the lower tapered surface 60 without detracting from the usefulness and advantages of the present invention. For example, in the absence of lower tapered surface 60, and consequentially annular shoulder 66, the outer diameter of head portion 48 may be formed to fit intimately with the inside diameter of elongated passageway 28. In such a preferred embodiment, certain flow characteristics will be altered for rendering a beneficial result in a particular application, while maintaining the advantages obtained in retaining the disclosed configuration and construction of the upper region.

With continued reference to FIGS. 2 and 3, spray nozzle 10 further includes an extension tube 20 which is defined by a hollow cylindrical tube having opposed externally threaded portions 68 and 70. Threaded portion 68 is engaged with threaded hub 34 of nozzle body 22. Nozzle tip assembly 16 includes a nozzle tip 72 having an internally threaded shoulder 74 which is engaged with threaded portion 70 of extension tube 20. An advantage of having the various components interconnected with threaded unions is that the spray characteristics, such as the spray pattern, of the spray nozzle 10 may be easily altered by replacing components to suit a particular need or application. For example, if it is determined that a relatively higher spray density is desired in an application, an operator may select a nozzle tip assembly 16 from a group or set of nozzle tip assemblies of differing dimensional characteristics which provides a particular reduced fan spray width. Alternatively, the operator may select a fluid inlet fitting 36 from a group or set of inlet fittings of various dimensional characteristics to provide one having a larger diameter fluid inlet passage 38. Those skilled in the art will readily appreciate that the threaded unions can be alternatively configured so as to be joined through adhesion, interference fit, or welding.

Figure 5:
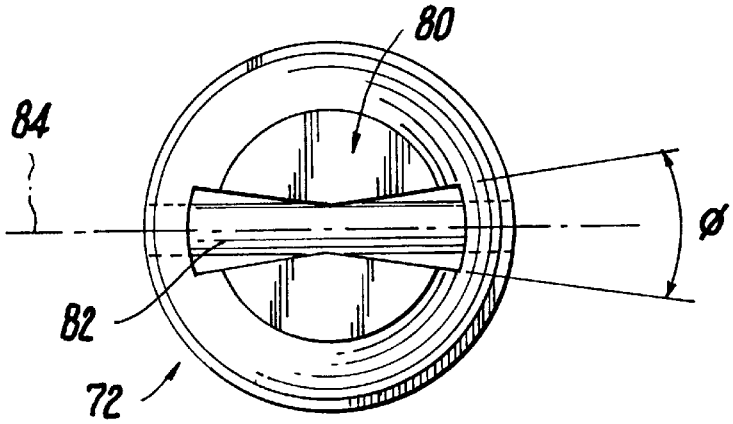
FIG. 5 is an end view, taken along line 5—5 of FIG. 2, for better illustrating the relationship between the deflection pin and the discharge orifice of the nozzle tip assembly.

Referring now to FIGS. 2, 3 and 5, nozzle tip 72 includes a bored hole 75 having a generally hemispherical bottom surface 76 provided therein. Bored hole 75 includes a stepped shoulder into which a pre-orifice member 78 is press fit. Pre-orifice member 78 has a fluid passage 79 extending therethrough for providing flow control of the fluid passing into nozzle tip 72. Pre-orifice member 78 can be removable to facilitate replacement by enlarging the diameter of the stepped shoulder and capturing the pre-orifice member 78 with the end face of extension tube 20. This variation in the construction of the present invention adds further flexibility to adjust the flow characteristics of spray nozzle 10.

Figure 6:
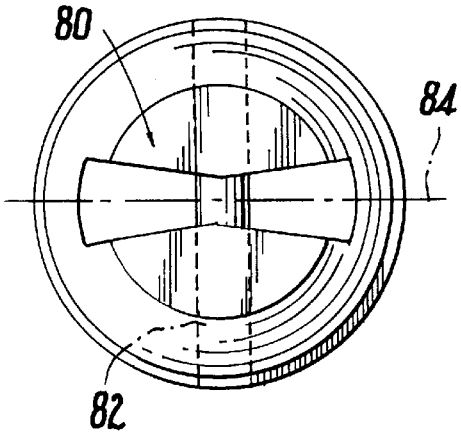
FIG. 6 is an end view of a spray nozzle similar to FIG. 5 illustrating an alternate embodiment nozzle tip assembly, wherein a deflection pin is oriented perpendicular to a longitudinal line of symmetry of a discharge orifice.

A discharge orifice 80 penetrates the lower wall of nozzle tip 72 to facilitate expulsion of the air/fluid mixture from the nozzle 10. A deflection pin 82 is pressed into a pair of through-holes oriented perpendicular to the longitudinal axis of bored hole 75 and parallel to the longitudinal line of symmetry 84 of discharge orifice 80. An alternate embodiment (FIG. 6) also has deflection pin 82 oriented perpendicular to the longitudinal axis of bored hole 75, however it is perpendicular to the longitudinal line of symmetry 84 of discharge orifice 80. Deflection pin 82 generally has the shape of a round dowel pin, however, it may have other cross-sectional shapes such as, for example, an oval or square cross-section. The shape selected will generally depend upon the application in which the nozzle is employed.

Deflection pin 82 creates two equally sized and laterally opposing orifices 86 and 88 that directly feed discharge orifice 80. A nozzle tip chamber 90 is formed between pre-orifice member 78 and deflection pin 82. Those skilled in the art will readily recognize that alterations and modifications to discharge orifice 80 will alter the fan spray pattern developed thereby. For example, reducing angle β (see FIG. 2) will reduce the width and increase the density of the emanating "fan", while reducing angle ϕ (see FIG. 5) will reduce the density of the emanating "fan" at its edges. In addition, discharge orifice 80 may be formed as a V- or U-shaped orifice providing yet another way to alter the fan shape to satisfy a particular application. In another preferred embodiment of the present invention, deflection pin 82 is absent from nozzle tip 72 so as to provide yet another way to alter the fluid-spray characteristics of spray nozzle 10.

In operation, fluid is fed under pressure to fluid inlet fitting 36. As the fluid passes the reduced diameter of fluid inlet passage 38, the flow rate of the fluid is increased while its volume of flow is reduced. The fluid exits the reduced diameter of fluid inlet passage 38 into annular fluid chamber 50 and impinges against the neck portion 46 of air inlet member 40. Thereafter, the fluid is injected equally through lateral fluid orifices 62 and 64 into the upper region 54 of mixing chamber 56. Simultaneously, pressurized air is injected through the reduced diameter of air orifice 52 into the upper region 54 of mixing chamber 56. The air and fluid continue to mix in the remaining (lower) portion of mixing chamber 56. It has been found that including the upper region 54 provides a substantial improvement in atomizing the fluid in comparison to spray nozzles found in the prior art.

The atomized fluid travels axially through extension tube 20 and becomes a uniform stream as it passes through pre-orifice member 78 into chamber 90 of nozzle tip 72. The uniform stream is divided into two uniform-flow liquid jets as it passes around deflection pin 82. Hemispherical bottom surface 76 redirects the flow of each jet toward each other causing them to impinge against one another and, thereafter, exit nozzle tip 72 through discharge orifice 80. Impingement of the jet streams against one another further atomizes the fluid-spray. As described above, the resulting shape of the discharged fluid spray is substantially determined by the shape of discharge orifice 80.

While the spray nozzle 10 disclosed herein is described for use in conjunction with a system for continuously cooling formed castings, those skilled in the art will readily recognize that such a spray nozzle may be employed to satisfy a variety of needs. For example, this invention may be used for spraying liquid preparations onto crops, cooling exhaust stacks, or scrubbing stack gases. Therefore, the description of the disclosed spray nozzle 10 to cooling castings should in no way be interpreted as a limitation of its use. In addition, although the preferred embodiment is described as having air being supplied through the air orifice 52 and fluid supplied through the fluid inlet passage 38, it should be understood that these terms are used to exemplify the invention and are in no way meant to limit the types of fluids that may be associated with either passageway.

Those skilled in the art will readily appreciate that modifications, changes or alterations may be made to the subject invention without departing from the spirit or scope of the claims appended hereto.

What is claimed is:

1. A nozzle assembly comprising:

a) a nozzle body having opposed inlet and outlet ends and an elongated passage extending therebetween;

b) a fluid inlet passage extending through a wall of said nozzle body to communicate with said elongated passage; and c) a member disposed within said elongated passage having a neck portion, a head portion depending from said neck portion, and an air passage extending through said neck portion to said head portion, said head portion dimensioned and configured to cooperate with a complementary portion defined within said elongated passage and having an outflow slot formed therein that traverses and intersects said air passage.

2. A nozzle assembly as recited in claim 1, wherein said head portion further includes an upper tapered surface that intersects the outflow slot formed in said head portion.

3. A nozzle assembly as recited in claim 1, wherein said head portion further includes a lower tapered surface and wherein said complementary portion of said elongated passage is defined by a shoulder having a surface configured to cooperate with said lower tapered surface.

4. A nozzle assembly as recited in claim 3, wherein said lower tapered surface and said shoulder surface are approximately parallel to one another and form about between a 20° to 60° angle with respect to the longitudinal axis of said elongated passage of said nozzle body.

5. A nozzle assembly as recited in claim 1, wherein said outflow slot extends to said neck portion of said member.

6. A nozzle assembly as recited in claim 1, further including a nozzle tip having an inlet end and an outlet end with a chamber extending therebetween, said inlet end of said nozzle tip in fluid communication with said outlet end of said nozzle body.

7. A nozzle assembly as recited in claim 6, further including an extension tube providing fluid communication between said outlet end of said nozzle body and said inlet end of said nozzle tip.

8. A nozzle assembly as recited in claim 6, further including a pre-orifice member positioned proximate said inlet end of said nozzle tip for regulating the flow of fluid into said chamber of said nozzle tip.

9. A nozzle assembly as recited in claim 8, wherein said chamber of said nozzle tip has a generally hemispherical bottom surface defined therein.

10. A nozzle assembly as recited in claim 9, wherein said outlet end of said nozzle tip defines a discharge orifice.

11. A nozzle assembly as recited in claim 10, further including a deflection pin disposed within said nozzle tip proximate said outlet end and approximately parallel to a longitudinal line of symmetry of said discharge orifice.

12. A nozzle assembly as recited in claim 10, further including a deflection pin disposed within said nozzle tip proximate said outlet end and approximately perpendicular to a longitudinal line of symmetry of said discharge orifice.

13. A nozzle assembly as recited in claim 8, further including a deflection pin disposed within said nozzle tip proximate said outlet end and approximately perpendicular to the longitudinal axis of said chamber.

14. A nozzle assembly comprising:

a) a nozzle body having opposed inlet and outlet ends and an elongated passage extending therebetween;

b) a fluid inlet passage extending through a wall of said nozzle body providing fluid communication with said elongated passage; and c) a member disposed within said elongated passage having a neck portion and a head portion depending from said neck portion, said head portion having an upper tapered surface and an outflow slot formed therein which intersects said upper tapered surface, said head portion configured to cooperate with a complementary surface defined within said elongated passage, and having an air passage extending longitudinally therethrough which intersects said outflow slot.

15. A nozzle assembly as recited in claim 14, wherein said head portion further includes a lower tapered surface and wherein said complementary surface of said elongated passage is formed on a shoulder and is in intimate contact with said lower tapered surface.

16. A nozzle assembly as recited in claim 15, wherein said lower tapered surface of said head portion forms about between a 20° to 60° angle with respect to the longitudinal axis of said elongated passage of said nozzle body.

17. A nozzle assembly as recited in claim 14, wherein said outflow slot extends to said neck portion of said member.

18. A nozzle assembly as recited in claim 14, further including a nozzle tip having an inlet end and an outlet end with a chamber extending therebetween, said inlet end of said nozzle tip in fluid communication with said outlet end of said nozzle body.

19. A nozzle assembly as recited in claim 18, further including an extension tube between said nozzle body and said nozzle tip providing fluid communication therebetween.

20. A nozzle assembly as recited in claim 18, further including a pre-orifice member positioned proximate said inlet end of said nozzle tip for regulating the flow of fluid into said chamber said nozzle tip.

21. A nozzle assembly as recited in claim 20, wherein said chamber of said nozzle tip has a generally hemispherical bottom surface defined therein.

22. A nozzle assembly as recited in claim 21, wherein said outlet end of said nozzle tip defines a discharge orifice.

23. A nozzle assembly as recited in claim 22, further including a deflection pin disposed within said nozzle tip proximate said outlet end and approximately parallel to a longitudinal line of symmetry of said discharge orifice.

24. A nozzle assembly as recited in claim 20, further including a deflection pin disposed within said nozzle tip proximate said outlet end and extending approximately perpendicular to the longitudinal axis of said chamber.

25. A nozzle assembly comprising:

a) a nozzle body having opposed inlet and outlet ends and an elongated passage extending therebetween;

b) a fluid inlet passage extending through a wall of said nozzle body directing fluid into said elongated passage;

c) a member disposed within said inlet end of said elongated passage, said member having a neck portion proximate said fluid inlet passage, a head portion depending from said neck portion, and an air passage extending longitudinally through said member, wherein said head portion is dimensioned and configured to cooperate with a complementary surface of said elongated passage and further includes an outflow slot that traverses and intersects said air passage; and d) a nozzle tip in fluid communication with said outlet end of said nozzle body.

26. A nozzle assembly as recited in claim 25, wherein said head portion further includes a lower tapered surface and wherein said complementary surface of said elongated passage is defined by a shoulder having a surface configured to cooperate with said lower tapered surface.

27. A nozzle assembly as recited in claim 26, wherein said lower tapered surface and said surface of said shoulder are approximately parallel and form about between a 20° to 60° angle with respect to the longitudinal axis of said elongated passage of said nozzle body.

28. A nozzle assembly as recited in claim 25, wherein said outflow slot extends to said neck portion of said member.

29. A nozzle assembly as recited in claim 25, wherein said nozzle tip includes an inlet end and an outlet end with a chamber extending therebetween, said inlet end of said nozzle tip in fluid communication with said outlet end of said nozzle body.

30. A nozzle assembly as recited in claim 29, further including an extension tube between said outlet end of said nozzle body and said inlet end of said nozzle tip.

31. A nozzle assembly as recited in claim 29, further including a pre-orifice member positioned proximate said inlet end of said nozzle tip for regulating the flow of fluid into said chamber of said nozzle tip.

32. A nozzle assembly as recited in claim 31, wherein said chamber of said nozzle tip has a generally hemispherical bottom surface defined therein.

33. A nozzle assembly as recited in claim 32, wherein said outlet end of said nozzle tip defines a discharge orifice.

34. A nozzle assembly as recited in claim 33, further including a deflection pin disposed within said nozzle tip proximate said outlet end and approximately parallel to a longitudinal line of symmetry of said discharge orifice.

35. A nozzle assembly as recited in claim 31, further including a deflection pin disposed within said nozzle tip proximate said outlet end and approximately perpendicular the longitudinal axis of said chamber.

36. A nozzle insert assembly comprising a nozzle tip having an inlet end and an outlet end with a chamber extending therebetween, said outlet end defining a discharge orifice and a generally hemispherical bottom surface, said nozzle insert assembly further including a pre-orifice member positioned proximate said inlet end of said nozzle tip for regulating the flow of fluid into said chamber, and a deflection pin disposed at least partially within a region enveloped by said generally hemispherical bottom surface proximate said discharge orifice for effecting the flow of fluid from said nozzle tip.

37. A nozzle insert assembly as recited in claim 36, wherein said deflection pin is disposed within said nozzle tip approximately parallel to a longitudinal line of symmetry of said discharge orifice.

38. A nozzle insert assembly as recited in claim 36, wherein said deflection pin is disposed within said nozzle tip approximately perpendicular to a longitudinal line of symmetry of said discharge orifice.

* * * * *